US011312609B2

(12) United States Patent
Valles et al.

(10) Patent No.: US 11,312,609 B2
(45) Date of Patent: Apr. 26, 2022

(54) KIT FOR DISPENSING A BEVERAGE THROUGH A DISPENSE TUBE COMPRISING A DISPENSE VALVE

(71) Applicant: ANHEUSER-BUSCH INBEV S.A., Brussels (BE)

(72) Inventors: Vanessa Valles, Leuven (BE); Lieven Dirx, Leuven (BE); Daniel Peirsman, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 17/277,913

(22) PCT Filed: Sep. 20, 2019

(86) PCT No.: PCT/EP2019/075315
§ 371 (c)(1),
(2) Date: Mar. 19, 2021

(87) PCT Pub. No.: WO2020/058471
PCT Pub. Date: Mar. 26, 2020

(65) Prior Publication Data

US 2021/0347625 A1 Nov. 11, 2021

(30) Foreign Application Priority Data

Sep. 20, 2018 (BE) ..... 2018/5644

(51) Int. Cl.
*B67D 1/04* (2006.01)
*B67D 1/08* (2006.01)

(52) U.S. Cl.
CPC ..... *B67D 1/0462* (2013.01); *B67D 1/0835* (2013.01); *B67D 1/0848* (2013.01); *B67D 1/0884* (2013.01)

(58) Field of Classification Search
CPC ... B67D 1/0462; B67D 1/0835; B67D 1/0848
(Continued)

(56) References Cited

U.S. PATENT DOCUMENTS 3,228,413 A 1/1966 Stevens, Jr.
9,434,595 B2 * 9/2016 Peirsman ..... B67D 1/0462
(Continued)

FOREIGN PATENT DOCUMENTS

EP 3173373 A1 * 5/2017 ..... B67D 1/0829
WO 2020058471 A1 3/2020

OTHER PUBLICATIONS

International Preliminary Report on Patentability for Application No. PCT/EP2019/075315 dated Apr. 1, 2021 (7 pages).
(Continued)

*Primary Examiner* — Jeremy Carroll
(74) *Attorney, Agent, or Firm* — Michael Best & Friedrich LLP

(57) ABSTRACT

A kit for dispensing a beverage through a dispense tube comprising a dispense valve, the kit comprising: •—an assembly of a keg (1) and a closure (2), the keg (1) and closure (2) assembly comprising: •a. an inner vent mechanism incorporated in the closure or at the interface of keg and closure, the inner vent mechanism configured to fluidly connect the inner space and intermediate space when an overpressure of predetermined value Poo occurs in the flexible bag; and •b. a safety relief mechanism (8*a*, 8*b*, 27) incorporated in the closure (2) or at an interface of closure (2) and keg (1), the safety relief mechanism designed to relief pressure when an overpressure h of predetermined value $P_{01}$ occurs in the keg, wherein Po1 is larger than Poo; •—a keg connector (38) comprising a base body and: •a) coupling means (40) for connecting the keg connector (31) to the neck portion (5) of the keg (1) or to the closure (2) of
(Continued)

said keg; •b) a dispense connector (38*a*) comprising a dispense tip (38*b*); •c) a gas connector (39*a*), comprising a gas tip (39*b*); characterized in that said connector comprises an overpressure relief vent (41) and an overpressure relief valve (42) to relief pressure when an overpressure in the gas tip (39*b*) reaches a predetermined overpressure value $P_{02}$ and in that at least one of following conditions are fulfilled: •i The predetermined overpressure $P_{02}$ at which the relief valve opens is smaller than Po1; •ii the coupling of the keg connector to the keg or closure increases the overpressure Po1 needed to activate the overpressure mechanism in the closure or at the interface of keg and closure to an overpressure Po1' larger than Po1, with $P_{o1'}$ being larger than $P_{02}$.

12 Claims, 7 Drawing Sheets

(58) Field of Classification Search
USPC ..... 222/94
See application file for complete search history.

(56) References Cited

U.S. PATENT DOCUMENTS

| | | | | |
|---|---|---|---|---|
| 2008/0257846 | A1 | 10/2008 | Hove et al. | |
| 2008/0257847 | A1 | 10/2008 | Van Hove et al. | |
| 2008/0257883 | A1 | 10/2008 | Van Hove et al. | |
| 2008/0258356 | A1 | 10/2008 | Van Hove et al. | |
| 2008/0260978 | A1 | 10/2008 | Van Hove et al. | |
| 2011/0024422 | A1 | 2/2011 | Valles et al. | |
| 2011/0024429 | A1 | 2/2011 | Vanhove et al. | |
| 2011/0248035 | A1 | 10/2011 | Peirsman et al. | |
| 2013/0175304 | A1 | 7/2013 | Peirsman et al. | |
| 2014/0077399 | A1* | 3/2014 | Pellaud | B32B 27/10 261/65 |
| 2018/0346311 | A1 | 12/2018 | Valles et al. | |
| 2019/0352165 | A1* | 11/2019 | Corstanje | B67D 1/0847 |
| 2021/0253413 | A1* | 8/2021 | Szeteli | B67D 1/0832 |

OTHER PUBLICATIONS

International Search Report and Written Opinion for Application No. PCT/EP2019/075315 dated Dec. 17, 2019 (14 pages).

* cited by examiner

KIT FOR DISPENSING A BEVERAGE THROUGH A DISPENSE TUBE COMPRISING A DISPENSE VALVE

TECHNICAL FIELD

The present invention concerns a kit for dispensing a beverage through a dispense tube with a dispense valve, in particular, a kit for dispensing a beverage on-trade such as bars or hotels, where tapping columns are provided with an, optionally disposable, dispense tube. The kit comprising a keg, in particular, a keg of the bag-in-bottle type, closed by a closure and a keg connector that is connected to or connectable to said dispense tube.

BACKGROUND TO THE INVENTION

Bag-in-kegs are steadily gaining market-share in a beverage kegs for on-trade. Such bag-in-kegs type comprise a rigid outer shell with a flexible inner bag provided therein for containing the beverage to be dispensed. An important advantage of bag in kegs type of kegs is that for dispensing of carbonated beverage a propellant can be introduced in an intermediate space between the inner bag and the outer shell, avoiding contact between the carbonated beverage and the propellant, resulting in improved beverage quality maintenance during the entire dispense cycle. Examples of cost effective bag-in-kegs have been developed allowing their extensive use in mass consumer goods such as beer kegs, cider kegs, and the like (cf. e.g., EP2146832, EP2148770, WO2010/031764, EP2152494, EP2152494, EP2152486, EP2152486, EP2148771).

Contrary to traditional kegs, the dispense tube and gas tube in bag-in-kegs need be connected to separate parts of the keg, the former in fluid communication with the interior of the inner bag, and the latter with the intermediate space between the inner bag and the outer keg. Note that the use of a dispense sword is not mandatory with bag-in-keg types of kegs, contrary to conventional kegs. To this effect, bag-in-keg type of kegs are usually provided with a closure comprising two separate openings: a dispense opening in contact with the interior of the inner bladder and a gas opening in contact with the headspace between inner bag and outer keg. Examples of closures suitable for bag-in-keg types of kegs are disclosed in WO2009/090224, WO2009/090223, WO2012004223.

With increased spreading of such kegs, control on correct use in compliance with prescribed safety regulations becomes more difficult and the need for fool-proof guaranteed safety throughout the supply chain and use of the kegs arises.

Whilst the afore-mentioned closures offer an overpressure relief mechanism during transport of the kegs from brewery to place of consumption, the overpressure relief mechanism does not offer a foolproof safety guarantee when a keg connector is coupled to the keg.

SUMMARY OF THE INVENTION

The present invention is defined in the appended independent claims. Preferred embodiments are defined in the dependent claims. In particular the present invention concerns a kit for dispensing a beverage through a dispense tube comprising a dispense valve, the kit comprising:

an assembly of a keg (1) and a 5), the keg comprising an outer shell (3) having a neck portion (5) defining a first access opening (6) and a flexible inner bag (10) having a neck finish (12) defining a second access opening (13); the closure (2) adapted to be fixed to the keg (1) in a sealing position wherein the closure (2) seals the first (6) and second (13) access openings of the keg thereby defining two sealed spaces, an intermediate space defined between the outer shell (3) and the flexible bag (10) and an inner space inside the flexible bag (10, the closure (2) comprising at least two distinct access ports, a first access port (25) dedicated to the first access opening (6) and a second access port (22) dedicated to the second access opening (13), the keg (1) and closure (2) assembly comprising:

a. an inner vent mechanism incorporated in the closure or at the interface of keg and closure, the inner vent mechanism configured to fluidly connect the inner space and intermediate space when an overpressure of predetermined value $P_{O0}$ occurs in the flexible bag; and b. a safety relief mechanism (8*a*, 8*b*, 27) incorporated in the closure (2) or at an interface of closure (2) and keg (1), the safety relief mechanism designed to relief pressure in the keg when an overpressure of predetermined value $P_{O1}$ occurs in the keg, wherein $P_{O1}$ is larger than $P_{O0}$;

a keg connector (38) for fluidly connecting the interior of the keg (1) with a dispense tube (35) connected to a dispense valve and with a pressure gas tube connected to a source of pressurized fluid, said keg connector (38) comprising a base body and further comprising the following elements:

a) coupling means (40) for firmly and releasably connecting the keg connector (38) to the neck portion (5) of the keg (1) or to the closure (2) of said keg for which the keg connector is designed;

b) a dispense connector (38*a*) comprising a substantially straight dispense tip (38*b*) extending along a longitudinal axis, Z, in fluid communication with a second end connected or connectable to the dispense tube (32) in fluid communication with a dispense valve (33);

c) a gas connector (39*a*), comprising a substantially straight gas tip (39*b*) extending along said longitudinal axis, Z, and physically separate from the dispense tip (38*b*), said gas tip (38*b*) being in fluid communication with a second end connected to a gas tube (34) connected or connectable to a source of pressurized fluid;

characterized in that said connector comprises an overpressure relief vent (41) being in fluid communication with, on the one hand, the gas tip (39*b*) and, on the other hand, the atmosphere and with an overpressure relief valve (42) arranged in said vent (41), the overpressure relief valve (42) designed to relief pressure when an overpressure in the gas tip (39*b*) reaches a predetermined overpressure value PO2 and in that at least one of following conditions are fulfilled:

i The predetermined overpressure $P_{O2}$ at which the relief valve opens is smaller than $P_{O1}$;

ii the coupling of the keg connector to the keg or closure increases the overpressure $P_{O1}$ needed to activate the overpressure mechanism in the closure or at the interface of keg and closure to an overpressure $P_{O1'}$ larger than $P_{O1}$, with $P_{O1'}$ being larger than $P_{O2}$.

$P_{O2}$ is preferably selected in a range of 3.5 to 6 bar, preferably in a range of 5.2 to 5.8 bar when measured at 23° C.

The second access port of the closure is preferably closed by wedge portion prior to coupling of a keg connector to the keg, the dispense tip of the keg connector piercing the wedge upon activation of the penetration actuation means and the second access port remaining open upon uncoupling the keg connector from the keg.

The closure preferably comprises first and second distinct sealing members, a first sealing member designed to engage the neck portion of the outer shell and sealing the interior of the outer shell from the atmosphere and a second sealing member engaging the neck finish of the inner bag and sealing the interior of the inner bag from the atmosphere and from an intermediate space between the outer shell and the inner bag, the first access port of the closure situated inward from the first sealing member and outward from the second sealing member, the second access port situated inward from the second sealing member.

The overpressure relief mechanism incorporated at the interface of closure and keg preferably comprises a fixation between the closure and the keg, the fixation comprising two positions, the closure being movable between a first sealing position wherein the first and second sealing members of the closure engage the keg and a second position, wherein at least the sealing between the first sealing member and the neck finish of the outer shell of the keg is disrupted, in an even more preferred embodiment the sealing between the first sealing member and the neck portion of the outer shell and the sealing between the second sealing member and the neck finish of the inner bag are both disrupted.

The first access port of the closure, dedicated to the intermediate space between the outer shell and the inner bag of the keg is preferably sealed from the atmosphere prior to the coupling of the keg connector to the keg or is open to the atmosphere prior to the coupling of the keg connector.

According to a preferred embodiment, the closure comprises a base (16) provided with a hub (18) having a peripheral edge extending into a skirt (17) and an inner edge of the hub extending into a central disc (19) by an intermediate wall (20) provided with an outwardly directed first shoulder (21) adjacent to the hub (18), and a further cylindrical wall portion (23) provided on said disc (19), the further wall portion (23) extending in a same sense as the skirt (17) and having a diameter that is smaller than the diameter of the disc (19), thereby creating a second shoulder (24), such that, when the closure is fixed to the keg in said sealing position, the first sealing member (28) is positioned in the first shoulder (21) and engages both said shoulder (21) and the inner edge of the neck portion (5) of the outer shell (3); and the second sealing member (29) is interposed between the second shoulder portion (24) and the inside of the neck finish (12) of the inner bag (10).

Preferably the base of the closure is flexible, allowing bulging of the base in case a predetermined overpressure $P_{O0}$ occurs in keg, thereby disrupting the sealing between the second sealing member and the neck finish of the inner bag and allowing venting of overpressure in the inner bag through the overpressure relief valve of the keg connector even in case this keg connector impacts the pressure relief mechanism provided between keg and closure.

The neck portion of the outer shell preferably comprises an outwardly extending rim, the coupling means of the keg connector comprising latches cooperating with the rim thereby firmly connecting the keg connector to the neck portion of the keg.

BRIEF DESCRIPTION OF THE FIGURES

In order to better explain the characteristics of the invention, the following preferred embodiments of an assembly according to the invention is given as an example only without being limitative in any way, with reference to the accompanying drawings, in which.

DETAILED DESCRIPTION

Keg and Closure Assembly

Figure 1:
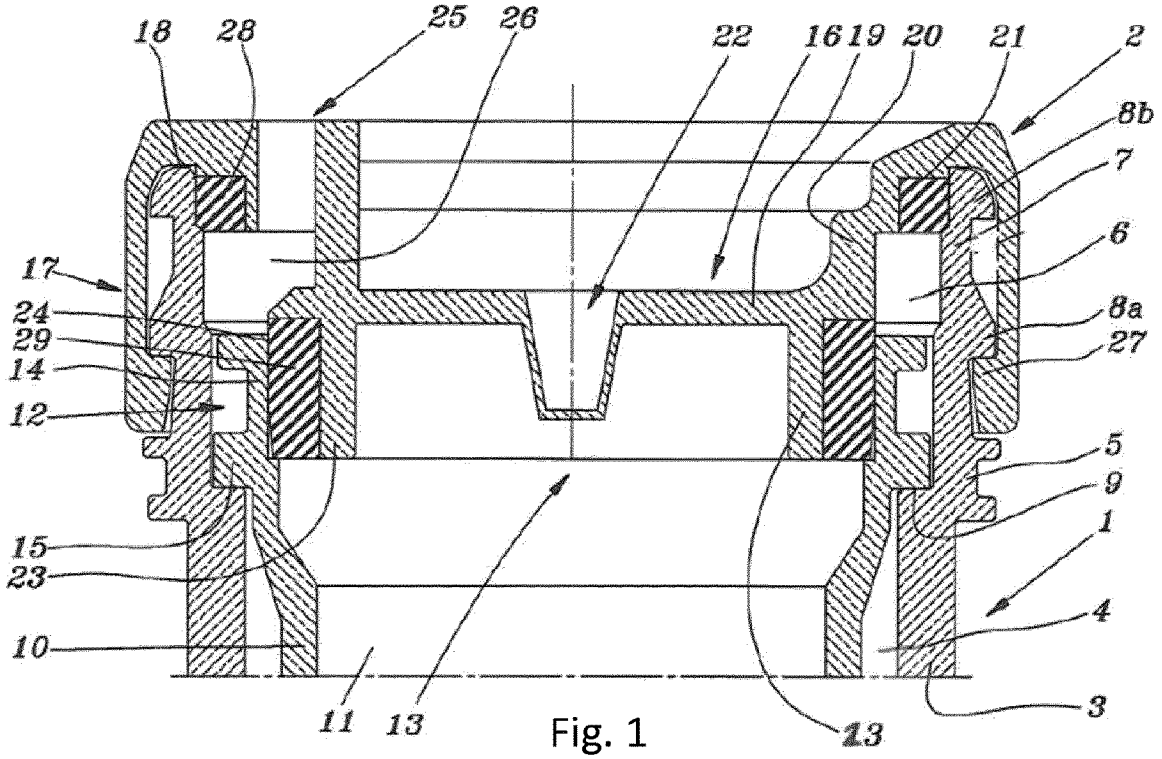
FIG. 1 represents a cross section of an assembly of a keg and closure of a kit according the present invention.

FIG. 1 represents an assembly of a keg and closure as part of a kit according to the present invention, the assembly comprising a keg 1 and a closure 2 fixed thereon.

The keg 1 comprises an outer shell 3 defining a space 4 and provided with a neck portion 5 defining an access opening 6. In the represented embodiment, the neck portion 5 comprises a cylindrical wall part 7 whereon are provided at least two sets 8*a* and 8*b* of outwardly extending protrusions, both sets being provided at a different level of the neck portion 5.

The neck portion 5 of the outer shell 3 further comprises a shoulder portion 9 creating a seat at the inner edge of the neck portion 5.

The different protrusions of a single set 8*a* or 8*b* are preferably positioned in an annular configuration and on a same level of the neck portion 5 and can be mutually spaced apart or can form a continuous annular rim.

In the space 4 defined by the outer shell 3 is provided an inner bag 10 manufactured in a flexible material. This inner bag 10 encloses an inner space 11 and is provided with a neck finish 12 defining an access opening 13. At its neck finish 12, the material thickness of the inner bag 10 is substantially thicker than over the rest thereof, making the neck finish 12 substantially rigid. The neck finish 12 essentially comprises a cylindrical wall part 14 provided with an outwardly extending rim 15 resting on the above mentioned seat 9 provided in the neck portion 5 of the outer shell 3.

Figure 3:
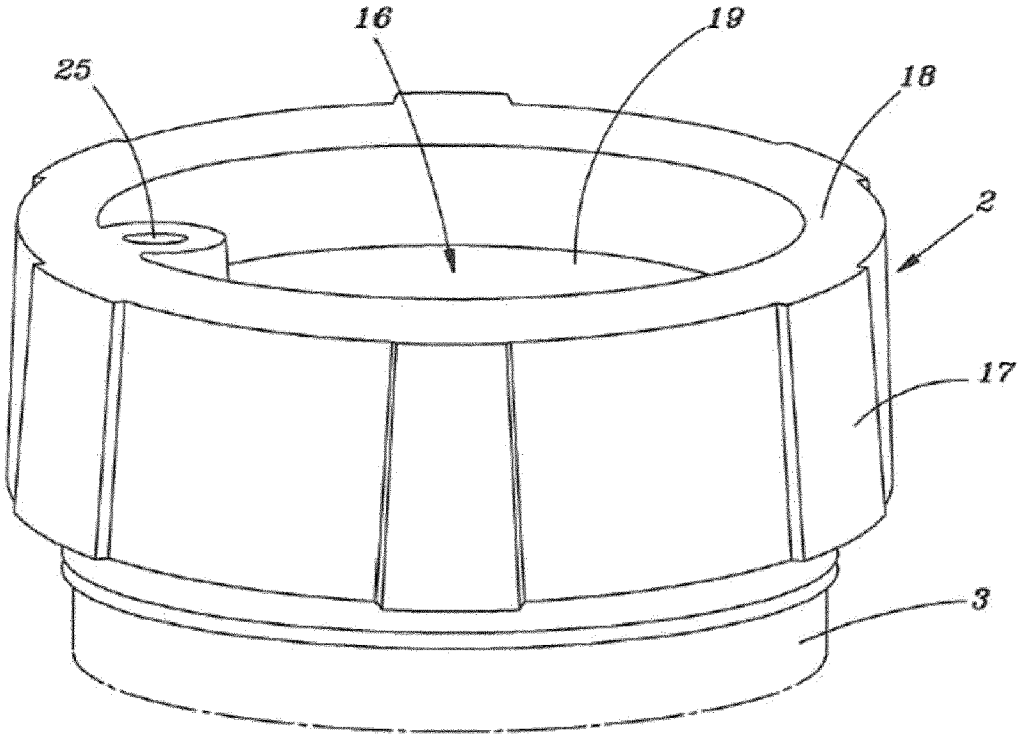
FIG. 3 represents a perspective view of a closure according the present invention.

As represented in FIG. 3, the closure 2 comprises a base 16 and a skirt 17 extending transversally with respect to the general plane of the base 16.

The base 16 is provided with a hub 18 having a peripheral edge extending into the skirt 17. The inner edge of the hub extends into a central disc 19 by a intermediate wall 20. As will be appreciated from FIG. 1, the intermediate wall 20 is provided with an outwardly directed shoulder 21 adjacent to the hub 18. The intermediate wall is preferably designed in a step-wise configuration.

The disc 19 is preferably provided with a wedged area 22 creating a piercable access port to the inner bag 10, while concentrically around the wedged area 22, a further cylindrical wall portion 23 is provided on said disc 19, the further wall portion 23 extending in a same sense as the skirt 17 and having a diameter that is smaller than the diameter of the disc 19, thereby creating a shoulder 24.

Along the intermediate wall 20 of the closure 2 is provided an access port 25 (first access port) to the space 4 intermediate the inner bag 10 and the outer shell 3. In the represented embodiment, this first access port 25 is created by a cylindrical tube extending in a same longitudinal direction as the closure 2 up to the above mentioned disc 19. The tube comprising an open end near the hub and a lateral opening 26 adjacent said disc 19.

Turning now to the skirt 17, it will be appreciated that it comprises a continuous cylinder, whereon a set of inwardly directed protrusions 27 is provided.

In an assembled position of the closure 2 and the keg 1, the closure is fixed in a first fixation position, wherein the protrusions 27 of the closure are snap-fitted behind the protrusions 8*a* of the keg 1. As clearly represented in FIG. 1, the further wall portion 23 partially extends in the access opening 13 defined by the neck finish 12, while the disc 19 of the closure 2 or at least the lateral opening 26 in the second access port 25 is situated in the access opening 6 of the outer shell, though not in the access opening 13 of the inner bag 10.

According to the invention, sealing means are provided in between the closure and the keg, said sealing means at least comprising a first sealing member 28 positioned between the closure 2 and the neck portion 5 of the keg. As such the first sealing member is positioned at the circumference of the access opening 6 of the outer shell 3. The sealing means further comprise a second, distinct sealing member 29 positioned between the closure 2 and the neck finish 12 of the inner bag 10. As such the second sealing member is positioned at the circumference of the access opening 13 of the inner bag 10. For the purpose of the present invention the term "distinct" should be understood that the sealing members 28-29 are acting on different, spaced apart places. In case both sealing members 28-29 are mutually connected by a connecting part having no sealing functionality the mutually connected sealing members 28-29 should be considered as distinct sealing members.

The first sealing member 28 is essentially a sealing ring made of a resilient, preferably elastomeric like material and positioned in the shoulder 21 provided at the intermediate wall 20 of the closure 2. As represented in FIG. 1, this sealing member 28 engages both said shoulder 21 and the inner edge of the neck portion 5 of the outer shell 3, thereby sealing the space 4 in the outer shell 3 from the atmosphere (apart from the second access port 25).

The second sealing member 29 is essentially cylindrical with open ends and is interposed between the shoulder portion 24 and the inside of the neck finish 12 of the inner bag 10, thereby segregating the space 4 in the outer shell 3 from the space 11 in the inner bag 10. This segregation of both spaces 4 and 11 allows both preventing fluids stored in the inner bag to leak into the space 4 in the outer shell 3, it also allows preventing fluid, in particular $O_2$, ingress in the inner bag 10. The second sealing member 29 is preferably manufactured in a same material as the first sealing member 28, though can also be manufactured in a different resilient and preferably elastomeric like material.

Figure 2:
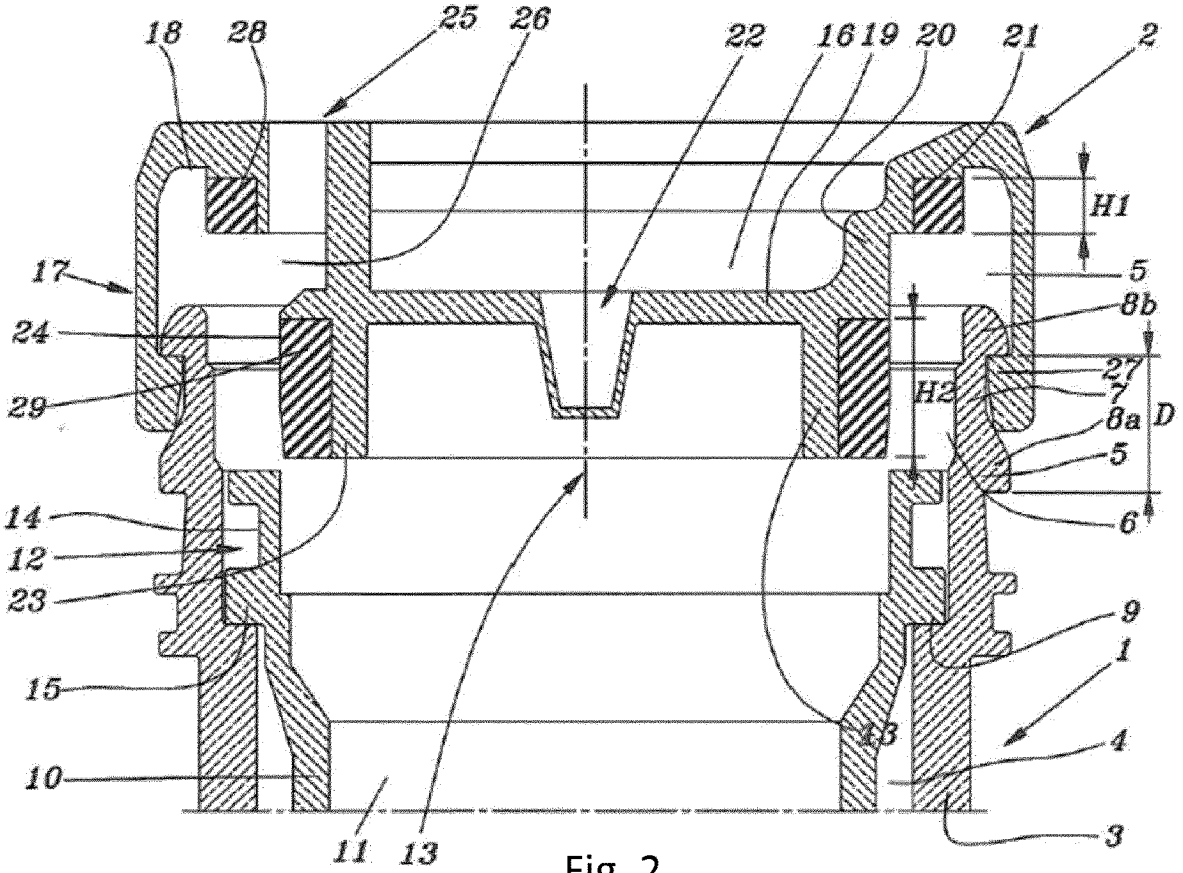
FIG. 2 represents a corresponding cross section of the assembly as FIG. 1, though in another fixation position of the closure on the keg.

In a preferred embodiment and as represented in FIGS. 1 and 2, the first sealing member 28 is provided between the intermediate wall 20 of the closure 2 and the radial inner surface of the neck portion 5 of the keg 1, while the second sealing member 29 is provided in between the radial outer surface of wall portion 23 of the closure 2 and the inner radial surface of neck finish 12 of the inner bag 10.

Preferably the height H1 and H2 of both sealing members 28 and 29 is smaller than the distance D between both sets of protrusions 8*a* and 8*b* provided on the neck portion 5 of the outer shell 3. It is noticed however, that the second sealing member 29 preferably has a substantial height H2. Furthermore, preferably at least the second sealing member 29 and even more preferably both sealing members 28-29 have a given thickness. This thickness is especially preferred when the closure 2 is manufactured in a material having a greater axial thermal expansion coefficient than the axial thermal expansion coefficient of the inner bags neck finish 12. As such, upon temperature increase, the closure will more closely fit in the neck portion of the keg 1, thereby compressing the second sealing member 29 between the closure and the radial inner surface of the neck finish 12 and ensuring good sealing against fluid leakage out of the inner bag 10. The thickness of the second sealing member 29 is hereby important to provide compression capability, since otherwise, the thermal expansion of the closure will act directly on the neck finish of the inner bag 10 and the neck portion 5 of the keg 1, and may cause damage. The thermal expansion coefficient is hereby defined as the relation between a change in temperature to a change in a material's linear dimensions. It is the fractional change in length per degree of temperature change. Furthermore, the thickness and/or height of the sealing members 28-29 allows good resistance against fluid permeation therethrough.

It is apparent that with the assembly according the invention, the sealing means do not form part of the access ports 22 and 25 and do not need to be pierced to gain access to the space 4 in the outer shell 3 or to the space 11 in the inner bag 10. In the case the closure 2 is positioned as represented in FIG. 1, i.e. in the fixation position the sealing means essentially provide only a sealing function and do not act as access ports.

In a preferred embodiment, both sealing members 28 and 29 are fixed to the closure 2, thereby facilitating the assembly of the closure 2 on the keg 1, while assuring that the sealing members 28 and 29 are positioned correctly. The fixation can be achieved by gluing, overmoulding or any other known fixation technique assuring good contact between the sealing members and the closure.

However, it is also possible to fix the sealing members on the keg or to use loose sealing members.

Overpressure Relief System

According to the invention the assembly of keg 1 and closure 2 comprises an overpressure relief system comprising a fixation between the closure 2 and the keg 1, said fixation comprising two positions in between which the closure 2 is movable.

In the represented embodiment, the overpressure relief system comprises both sets of protrusions 8*a* and 8*b* of the neck portion 5 as well as the skirt 17 and the corresponding set of protrusions 27.

In the above configuration of the assembly according to the invention, the first fixation position is the one wherein the set of protrusions 27 located on the skirt 17 are snap fitted (i.e. clamped) behind the set of protrusions 8*a* located closest to the kegs body and wherein the closure 2 seals said opening 6 of the outer shell 3 and the opening 13 of the inner bag 10.

A second fixation position is represented in FIG. 2 and is defined as the position wherein the set of protrusions 27 of the skirt 17 are snap fitted behind the set of protrusions 8*b* located distant from the kegs body. In this second fixation position, the sealing of the openings 6 and 13 is disrupted. The disruption of the sealing is assured by designing the sealing members 28 and 29 such that their height H1 and H2 is smaller than the distance D where over the closure 2 is moved by altering its fixation position. Clearly, disrupting the sealing of the space in the inner bag 10 in view of the atmosphere allows overpressure relief. Upon positioning the closure 2 in the first (sealing) fixation position and an overpressure arises (=the difference in pressure between the inner keg ($P_{ik}$) and the atmosphere ($P_{Atm}$)) above a threshold value $P_{O1}$ in the keg, the overpressure will force the closure 2 upward into the second fixation position, wherein the overpressure is released, without the closure being loosened from the keg. As such a controlled system is obtained to handle the safety issue of overpressure occurring in the keg 1.

In the above described embodiment, the different protrusions can either be distinct spaced apart protrusions or can form a continuous ring.

In case the protrusions 27 form such a continuous ring and in the case the protrusion 8*b* located distant from the keg 1 form a continuous rim, it is preferred that in either the ring or the rim or in both are provided some lateral grooves (not shown) that ensure contact between the space 4, 11 confined by the keg and the environment when the closure 2 is positioned in the second fixation position (i.e. the position allowing overpressure relief).

Appropriate materials for both the outer shell and the closure or at least the elements constituting the overpressure relief system are stainless steel or one or more of a synthetic material such as for example polyesters and/or polyolefins.

In accordance with the above described embodiments, the neck portion 5 comprises at least two sets of protrusions 8*a* and 8*b*, while the closure is provided with at least one set of protrusions 27. In accordance with further embodiments the overpressure relief system can also comprise at least two sets of protrusions on the closure 2, and at least one set of protrusions on the neck portion 5, wherein during movement of the closure 2 from a first fixation position to a second fixation position, the same set of protrusions on the neck portion 5 disengages the first set of protrusions of the closure 2 and subsequently engages the second set of protrusions of said closure 2.

Apart from the above described overpressure relief system that is primarily meant as a safety measure when the pressure in the keg increases to a level where burst of the keg or the closure or closure blow off may occur, it is noted that the design of the closure as described in the preferred embodiment also comprises an inner vent mechanism that allows gradual pressure release at lower pressure levels. Indeed, upon pressure build up to a level $P_{O0}$, below $P_{O1}$, the base of the closure will slightly deform, i.e. bulge outward. The bulging results in an axial displacement of the closure 2 in a direction out of the keg 1 and of a distance that is smaller than the height of the second sealing member 29 that remains engaged. As a result of the displacement of the closure 2, the head space in the keg increases in volume and the pressure inside the keg will slightly drop. When the pressure still further increases, the closure will bulge out some more and the second sealing member 29 will disengage from the inner surface of the neck finish 12. As such active venting is allowed. Once the pressure drops, the closure will regain its original form and the sealing member 29 will be reengaged.

The bulging of the closure and particularly the axial displacement resulting there from is, in this case, attained by the step-wise design of the intermediate wall 20 of the closure 2, allowing a displacement of the base 16 without any major displacement of the hub 18 and hence without loosening the snap fit.

Alternative Embodiment

Figure 4:
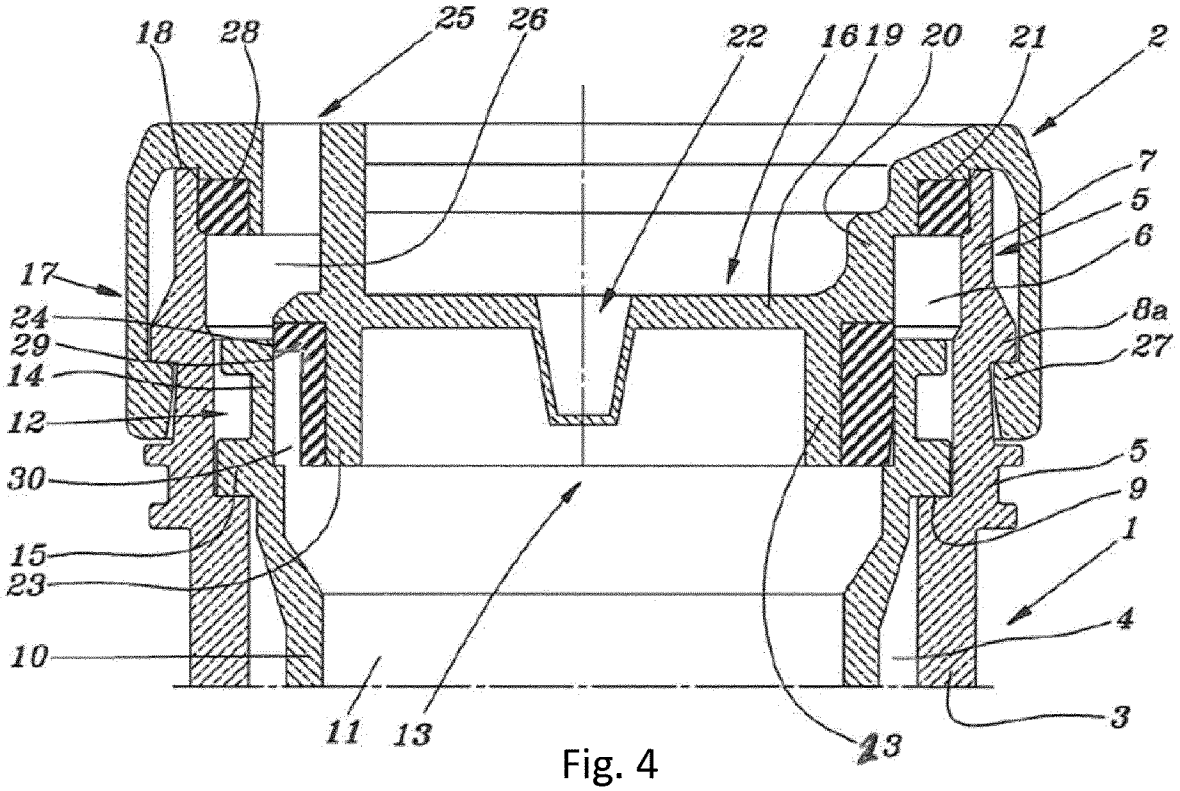
FIGS. 4 and 5 represent cross sections corresponding to FIGS. 1 and 2, in alternative embodiment mode.
Figure 5:
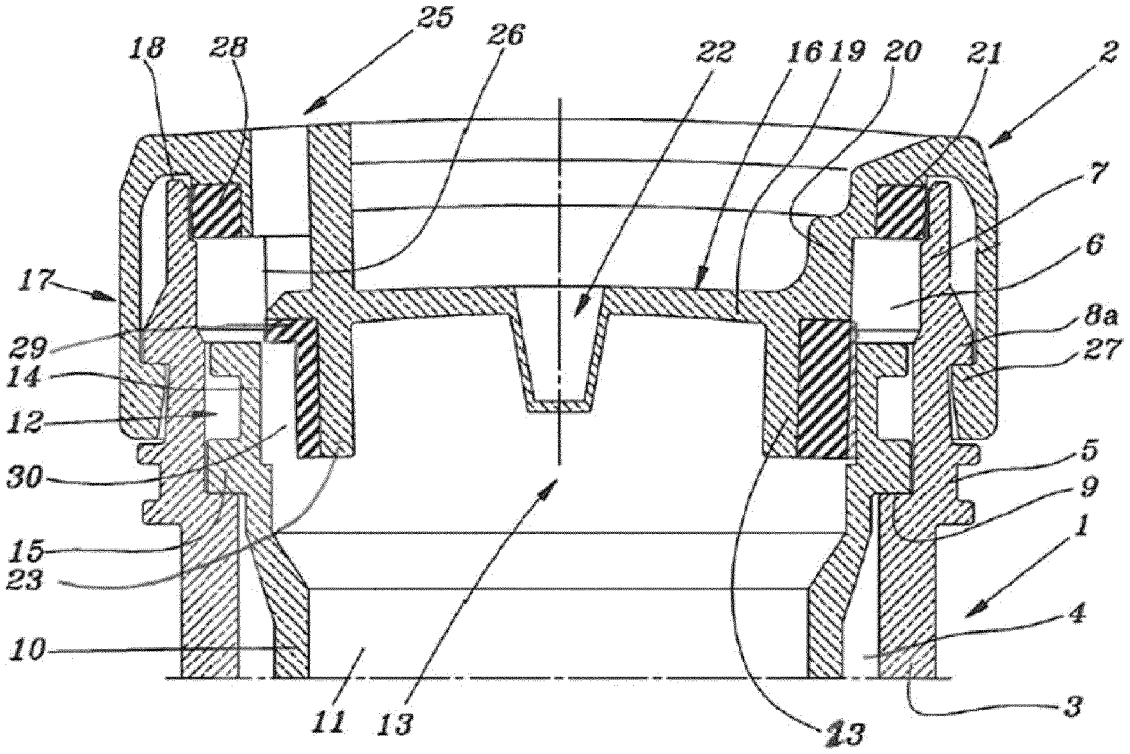

FIGS. 4 and 5 represent an alternative embodiment of an assembly according the present invention. The assembly corresponds to the assembly described with reference to FIGS. 1 to 3. In this alternative embodiment the inner vent mechanism at the interface of closure and keg or in the closure is provided for by the base 16 of the closure that is designed such to provide flexibility resulting into outwards bulging upon sealing a keg 1 wherein a given overpressure $P_{O0}$ occurs in the inner bag.

As will be appreciated from FIG. 5, in case a given overpressure $P_{O0}$ arises in the keg's inner bag 10, the base 16 of the closure will bulk outward, thereby displacing the second sealing member 29. Due to that displacement, the second sealing member 29 will be displaced such that the part or parts of that sealing member 29 situated in the extension of the intrusions 30 is disengaged from the inner bag's neck finish 12. As such, the intrusions 30 form venting channels between the space 11 in the inner bag and the intermediate space 4 which, in turn, is in communication with the ambient atmosphere via the first access port 25, thereby allowing overpressure relief when no keg connector is fitted on the keg. Alternatively, the first sealing member 28 can also be provided with an intrusion corresponding to the intrusion 30 in the second sealing member 29, such that in case of deformation of the closure 2, the first sealing member 28 too disengages.

From the above, it is evident that such design options can be achieved in numerous manners well-known in the practice of manufacturing.

Alternatively as described with reference to FIGS. 1 to 3 resides in the design of the sealing member 29 positioned in between the closure 2 and the neck finish 12 of the inner bag 10. This sealing member 29 is essentially cylindrical with open ends and is provided with at least one and preferably several intrusions 30 positioned along the outer edge of the sealing. These intrusions 30 extend over a part of the height H2 of the sealing member 29 at that side of the sealing member 29 that—upon assembly, between closure and keg—is directed towards the inside of the keg. The part or parts of the sealing positioned in the extension of these intrusions have a height H2' which is less than the displacement of the base of the closure during deformation caused by the overpressure in the inner bag of the keg.

Upon pressure drop at a given level, the closure will regain its original form and the sealing members will be reengaged and reseal the inner space 11 from the intermediate space 4 the intermediate space 4 being sealed from the ambient atmosphere.

From the above, it is evident that for the alternative embodiment, the fixation of the closure to the keg is not limited to a so-called snap-fit fixation, but can also be achieved in numerous other fixation means such as, for example, by means of a thread.

Keg Connector

The kit (FIG. 6) according to the present invention for dispensing a beverage, further comprises a keg connector 31 for fluidly connecting the interior of the keg 1 with a dispense tube 32 connected to a dispense valve 33 (or pinch valve) and with a pressure gas tube 34 connected to a source of pressurized fluid 35.

Figure 7:
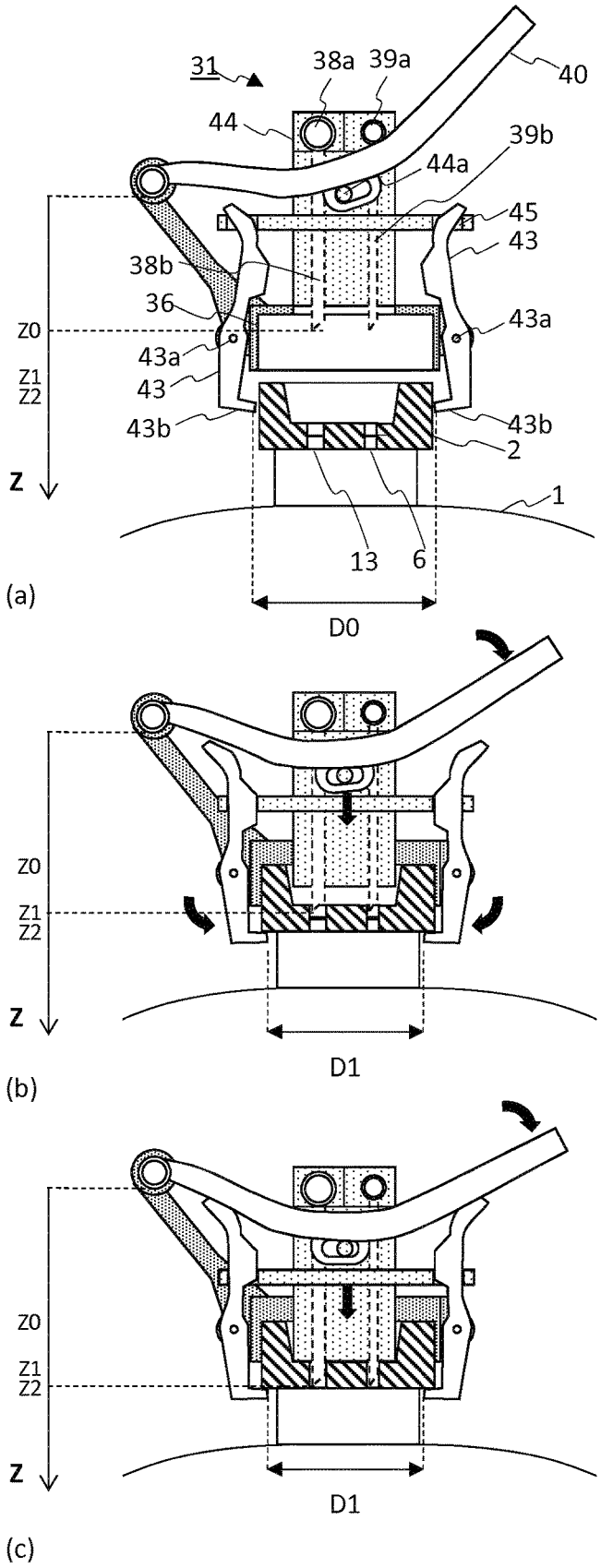
FIGS. 7 to 9 illustrate several alternative embodiments of a keg connector of a kit according to the present invention.

As represented in FIG. 7, the keg connector comprises a base body 36 provided with an interface suitable for engaging the closure 2 of the keg 1 and comprises the following elements:

a) coupling means 37 for firmly and releasably connecting the keg connector 31 to the neck portion of the keg 1 or to the closure 2 of said keg for which the keg connector 31 is designed;

b) a dispense connector 38*a* comprising a substantially straight dispense tip 38*b* extending along a longitudinal axis, Z, in fluid communication with a second end connected or connectable to the dispense tube 32 in fluid communication with the dispense valve 33;

c) a gas connector 39*a*, comprising a substantially straight gas tip 39*b* extending along said longitudinal axis, Z, and physically separate from the dispense tip 38*b*, said gas tip being in fluid communication with a second end connected to a gas tube connected or connectable to the source of pressurized fluid 35;

d) coupling actuating means 40 for reversibly bringing the coupling means 37 from an uncoupled to a coupled position, in which the keg connector 37 is firmly coupled to the keg neck or keg closure 2, with the dispense tip 38*b* and gas tip 39*b* facing the corresponding access ports 22, respectively 25, of the keg closure 2;

e) penetration actuating means 40 for moving by a given distance along the longitudinal axis, Z, the dispense tip 38*b* and gas tip 39*b* from a first retracted position, Z1, to a second connected position, Z2, wherein said distance is sufficient for the dispense tip 38*b* and gas tip 39*b* to penetrated through the corresponding access ports 22 and 25 provided in the keg closure f) an overpressure relief vent 41 being in fluid communication with, on the one hand, the gas tip 39*b* and, on the other hand, the atmosphere and with an overpressure relief valve 42 arranged in said vent 41, the overpressure relief valve 42 designed to relief pressure when an overpressure in the gas tip 39*b* reaches a predetermined overpressure value $P_{O2}$ and in that at least one of following conditions are fulfilled:

i The predetermined overpressure $P_{O2}$ at which the relief valve 42 opens is smaller than $P_{O1}$;

ii the coupling of the keg connector 31 to the keg 1 or closure 2 increases the overpressure $P_{O1}$ needed to activate the overpressure mechanism 8, 27, the closure 2 or at the interface of keg and closure to an overpressure $P_{O1'}$ larger than $P_{O1}$, with $P_{O1'}$ being larger than $P_{O2}$.

Figure 6:
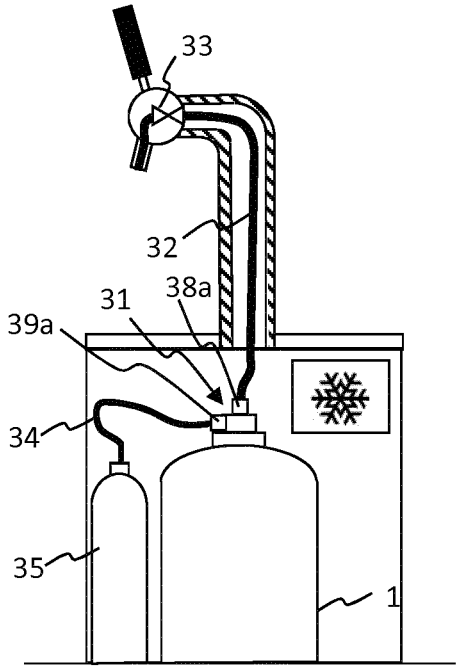
FIG. 6 schematically illustrates a typical setup of a kit according to the present invention.
Figure 8:
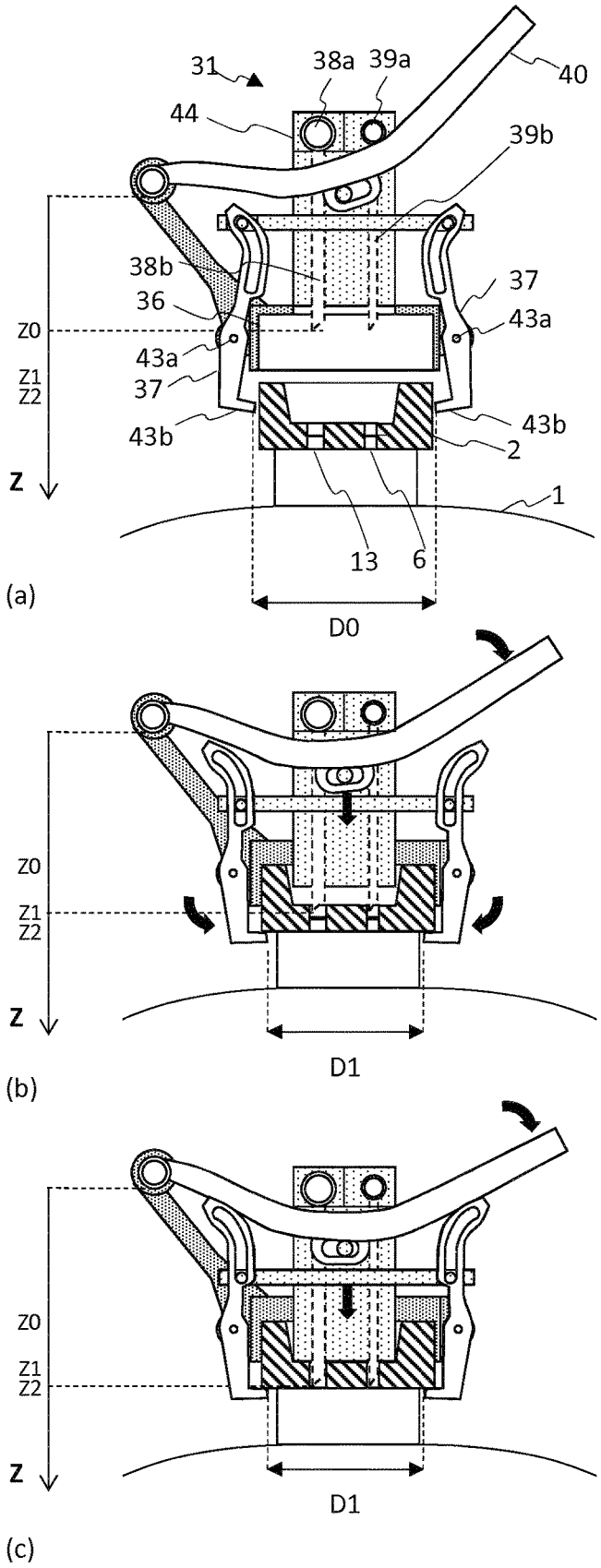
Figure 9:
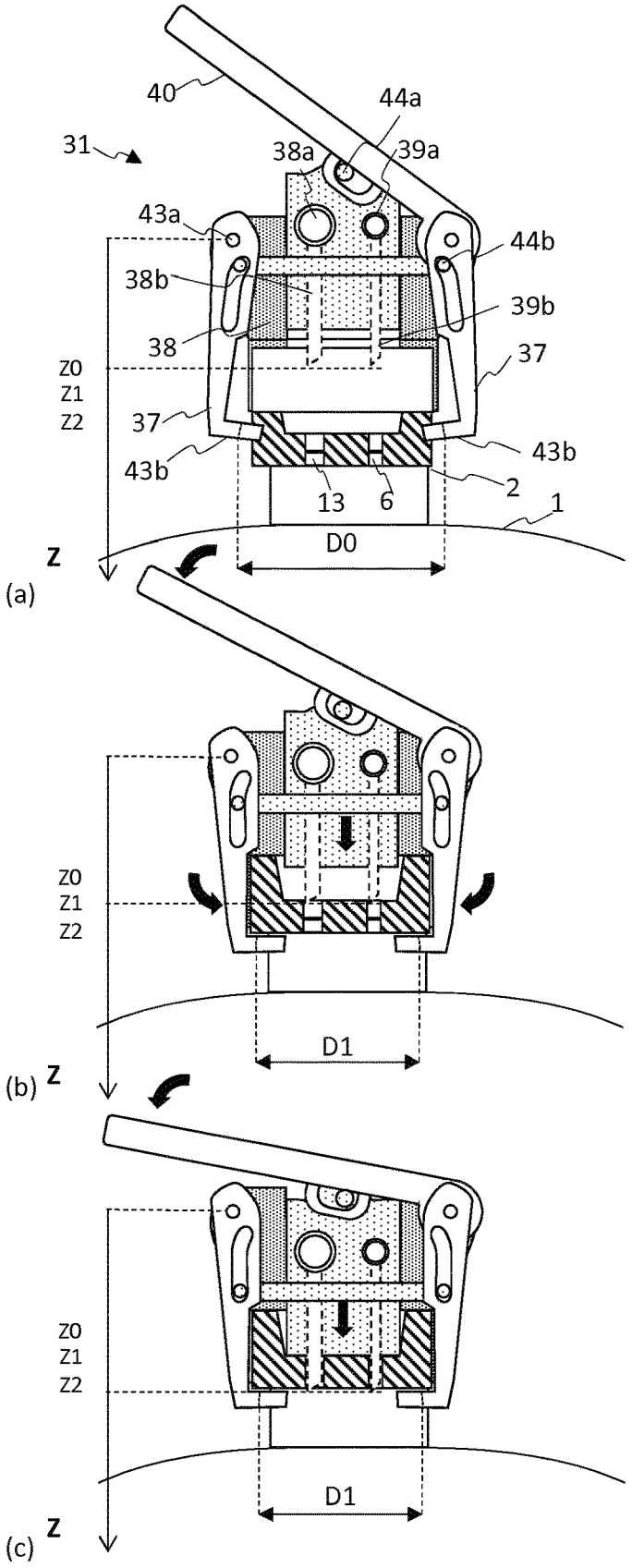

FIGS. 7 to 9 illustrate some preferred embodiments of keg connectors applicable with the present invention. The keg connector comprises the base body 36 provided with an interface suitable for engaging the closure 2 of keg 1. The various elements of the keg connector 31 are mounted on said base body 36. The coupling means 37 are mounted on said base body, for firmly and reversibly coupling the keg connector 31 to the neck 5 of keg 1 or to the closure 2 of said keg. The keg connector 31 receives a dispense connector 38*a* and a gas connector 39*a* which are connected to the dispense tube 32 and gas tube 34, respectively. An example of dispense connector 38*a* is illustrated in FIG. 6. A gas connector 39*a* has similar geometry, and the features described with respect to the dispense connector 38*a* apply mutatis mutandis to the gas connector 39*a*. The dispense and gas connectors 38*a*, 39*a* each comprises a substantially straight dispense tip 38*b*, 39*b* extending along a longitudinal axis, Z, and suitable for penetrating and, if it applies, piercing a dispense opening 22 and gas opening 25 of the closure 2 of the keg 1. In this case a single actuating means 40 allows with a single movement to reversibly bring the coupling means 40 from an uncoupled to a coupled position, in which the keg connector 31 is firmly coupled to the keg neck 5 or keg closure 2, with the dispense tip 38*b* and gas tip 39*b* facing without penetrating corresponding dispense opening 22 and gas opening 25 provided on said keg closure; and to reversibly move by a given distance along the longitudinal axis, Z, the dispense tip 38*b* and gas tip 39*b* from a first retracted position, Z0, to a second connected position, Z2, wherein said distance is sufficient for the dispense tip 38*b* and gas tip 39*b* to penetrate into the corresponding dispense opening 22 and gas opening 25 provided on the keg closure 2, and thus establish fluid communication with the interior of the keg 1.

It is preferred that the coupling means 40 be in their coupled position before the dispense tip 38*b* and gas tip 39*b* have engaged the corresponding dispense and gas openings 22, 25 with any significant force to either tear open a seal or to force the passage through a resilient sealing ring (not shown). If this happened before the coupling means 40 were in their coupled position, the keg connector would risk to be disengaged from the keg neck 5 or keg closure 2. For this reason it is preferable that, as the coupling means 40 reach their coupled position, the dispense tip 38*b* and gas tip 39*b* have moved along the longitudinal axis, Z, by an intermediate distance Z1<Z2, wherein said intermediate distance, Z1, is less than the distance required by the dispense tip 38*b* and gas tip 39*b* to penetrate through the corresponding dispense and gas openings 22, 25 of the keg's closure 2 for which the keg connector is designed. Thereafter, the coupling means maintain their coupled position, and the dispense and gas tips 38*b*, 39*b* continue their translation along the longitudinal direction, Z, from their intermediate position, Z1, to their connected position, Z2, to establish fluid communication with the interior of the keg.

In a preferred embodiment, the coupling means 40 comprises a first and second latches 43 pivotally mounted on hinges 43*a* disposed on opposite sides of the keg connector base body 36, one free end of each of said latches ending in a protrusion 43*b* extending towards each other. The protrusions 43*b* have a geometry suitable for mating a surface of the keg neck they are designed for. Upon actuation of the single actuating means 40 the distance, D, separating the tips of each protrusion 43*b* is varied from an uncoupled distance, D0, greater than at least one dimension of the keg's neck or keg's closure for which the keg connector is designed, such that the keg connector can be freely moved in the longitudinal direction, Z, until reaching its coupling position to said keg, to a coupled distance, D1<D0, smaller than a dimension of the keg's neck or keg's closure such that the keg connector is firmly fixed to said keg's neck or keg's closure 2.

The dispense and gas connectors 38*a*, 39*a* are preferably supported on a support element 44 movable in the longitudinal direction, Z, with respect to the keg connector base body 36. Said support element 44 is interconnected with each latch 43, such that by moving the support element 44 along the longitudinal direction, Z, from said retracted position, Z0, to said intermediate position, Z1, the latches 43 are driven to pivot about their respective hinges 43*a* such that the distance between the tips of the latch protrusions 43*b* is decreased from the uncoupled distance, D0, to the coupled distance, D1. Upon moving the support element 44 further along the longitudinal direction, Z, from said intermediate position, Z1, to said connected position, Z2, the distance between the tips of the latch protrusions remains substantially constant at their coupled distance value, D1.

The single actuating means 40 is preferably a lever, pivotally mounted on the base body 36 of the keg connector with a hinge 40*a*. It is preferably interconnected with the support element 44 supporting the dispense and gas connectors 38*a*, 39*a* such that pivoting the lever up or down about its hinge 40*a* drives the support element up or down with respect to the base body 36 along the longitudinal direction, Z, between its retracted position, Z0 and its coupled position, Z2, passing by its intermediate position, Z1. The connection between the lever 40 and the base body 36 is preferably of the type of a pin 44*a* engaged in a bean shaped slot, so that the rotational movement of the lever about its hinge 40*a* can be translated into a rectilinear translation of the support element 44 along the Z-direction. Other connection types can be envisages, such as a hinged rod, as long as it permits to transmit a linear motion to the support element 44. Guiding means (not shown) such as rails, or mating protrusion/groove systems can be provided to guide along the longitudinal direction, Z, the translation of the support element with respect to the base body 36. A lever is advantageous, because it allows the application of considerable forces with little efforts from an operator. This is important because, on the one hand, high forces may be required for the coupling because the keg is pressurized and tight sealing elements and coupling forces are required to maintain the system gas tight and, on the other hand, the operator is often in an uncomfortable position, crouched under the counter in often dark and noisy environments.

As explained supra, the rotational movement of the lever 40 about its hinge 40*a* drives the linear movement along axis Z of the support element 44 with respect to the base body 36 through the connection 44*a* between them. In a preferred embodiment, the support element 44 is interconnected with the latches 40 such that the linear translation up and down along the longitudinal direction, Z, between the retracted position, Z0, and the intermediate position, Z1, of the support element 44 drives the pivoting of the latches 40 from their uncoupled position, D0, when the support element is at its retracted position, Z0, to its coupled position, D1, when the support element is at its intermediate position, Z1. The connection between the latches 40 and the support body 44 is also such that moving the latter along the Z-direction between its intermediate position, Z1, and its connected position, Z2, does not affect the position of the latches 40 anymore, which maintain their coupled configuration, D1.

The interconnection between the support element 44 and the latches 40 can be in the form of either:

(a) A curved sliding surface 43*b* of the latches 40 engaged in corresponding openings 45 of the support element 44 (cf. FIG. 6), (b) A pin 44*p* provided on the support element 44 engaged in an opening 45 in the shape of a curved bean slot provided on a latch 40 (cf. FIGS. 7 & 8), or (c) A pin provided on a latch 40 engaged in an opening 45 in the shape of a curved bean slot provided on the support element 44 (not shown).

The geometries of the bean shaped slots or sliding surfaces are such that the linear movement of the support element 44 with respect to the base body 36 along the longitudinal axis, Z, generates the desired pivoting movement of the latches. For example, in the embodiments illustrated in FIGS. 6 and 7, each latch 40 is pivotally mounted on a hinge 43*a* in its intermediate section comprised between the two ends thereof, thus defining:

(a) a first, lower latch section comprised between the hinge 43*a* and the end provided with the protrusion 43*b*, and (b) a second, upper latch section comprised between the hinge 43*a* and the latch second end.

In the embodiment of FIG. 7, the second, upper section of each latch 43 comprises a sliding surface 43*b* having a specific curvature which is engaged in a slot 45 provided at appropriate positions on the support element 44 supporting the dispense and gas connectors 38*a*, 39*a*, such that as the support element 44 moves along the Z-direction, the slots 45 receiving the second portion of each latch 43 slide along the curved surface 43*b* of the second upper portion of each latch. The slots 45 and the sliding surfaces 43*b* have a geometry and dimensions such that as the support element 44 and slots 45 have moved with respect to the latches from the retracted position, Z0, to the intermediate position, Z1, the tip of the latch protrusions 43*b* are brought closer together from an uncoupled distance, D0, to a coupled distance, D1. As illustrated in FIG. 6, the clamping of the latches is triggered by the slots 45 sliding along the first inner protrusion of the curved surface 43*b* located between the positions of the slots 45 in FIGS. 6(*a*) and 6(*b*). The geometry of the curved surface 43*b* is preferably such that as the support element further moves down from the intermediate position, Z1, to the connected position, Z2, the latches 43 do not pivot anymore. This is easily achieved by providing a straight surface portion 43*b* extending parallel to the Z-direction along which the slots 45 can run freely, as shown in FIGS. 6(*b*) & (*c*).

The embodiment of FIG. 8 is very similar to the one of FIG. 6, with the exception that the slots 45 are now provided on the latches 43, whilst pins 44*p* mounted on the support element 44 are engaged in such slots 45. As can be appreciated in FIG. 7, the slots 45 comprise a top portion which is curved such that the translation of the pins 44*p* along the Z-direction drives the pivoting of the latches 43 about their hinges 43*a* such that the protrusions 43*b* of the latches are brought closer together from an uncoupled distance, D0 to a coupled distance, D1 (cf. FIGS. 7(*a*) & (*b*)). The length of the curved top portions of the latches 43 projected over an axis Z is equal to the difference Z1−Z0. The slots 45 comprise a lower portion which is rectilinear and extends parallel to the Z-direction when the latches are in their coupled position, D1, such that the translation of the pins 44*p* along the Z-direction between the intermediate position, Z1, and the connected position, Z2, does not affect the distance, D, between the latch protrusions 43*b*. At the same time, the dispense and gas tips 38*b*, 39*b*) have engaged and fully penetrated the dispense and gas openings 22, 25 of the closure 2, when the support element (13) has reached the connected position, Z2, thus establishing fluid communication between the interior of the container 1 and the dispense and gas tubes 32, 34.

In the embodiments of FIGS. 6 and 7, the top, inner surface of the latches 43 has such geometry that when the lever 40 is at its lowest position, corresponding to the connected position, Z2, of the support element 44, the lever rests on said top inner surfaces thus blocking the latches in their coupled position. This adds a level of safety in preventing any risk of the latches suddenly opening and uncoupling the keg connector 31 from the closure 2 or the keg neck 5.

In an alternative configuration, an embodiment thereof being illustrated in FIG. 9, each latch is hinged 43*a* at its end opposite the end comprising a protrusion 43*b*. The lever 40 is preferably, bur bot necessarily, hinged at the same hinge 43*a*, 40*a* as one of the latches as illustrated in FIG. 8. As in the former embodiments (cf. FIGS. 6 & 7) the lever is also coupled 44*a* to a support element 44 such that rotating up and down the lever about its hinge 44*a* drives the translation of the support element 44 along the Z-direction. The support element 44 supports the dispense and gas connectors 38*a*, 39*a* such that the dispense and gas tips 38*b*, 39*b* are oriented with their axes extending parallel to the longitudinal direction Z. The support element is coupled to the latches by means of a pin 44*p* engaged in a bean shaped slot 45. As illustrated in FIG. 8, the pins 44*p* can be mounted on the support element 44 and the bean shaped slot 45 on the latches, but it is clear that the pin can be part of the latches and the slots be part of the support element with the same effect. Upon moving the support element 44 along the Z-direction between the retracted position, Z0, and intermediate position, Z1, the pins 44*p* run along a curved portion of the bean shaped slots 45 which have a geometry such that the latches are driven to pivot about their hinges 44*a* from an uncoupled position, D0, to a coupled position, D1 (cf. FIGS. 8(*a*) & (*b*)). As the support element 44 moves further from the intermediate position, Z1 to the connected position, Z2, the pins move relative a straight portion of the bean shape slots 45 extending parallel to the Z-direction, such that the position of the latches is not affected by the displacement of the support element 44 (cf. FIGS. 8(*b*) & (*c*)).

Figure 10:
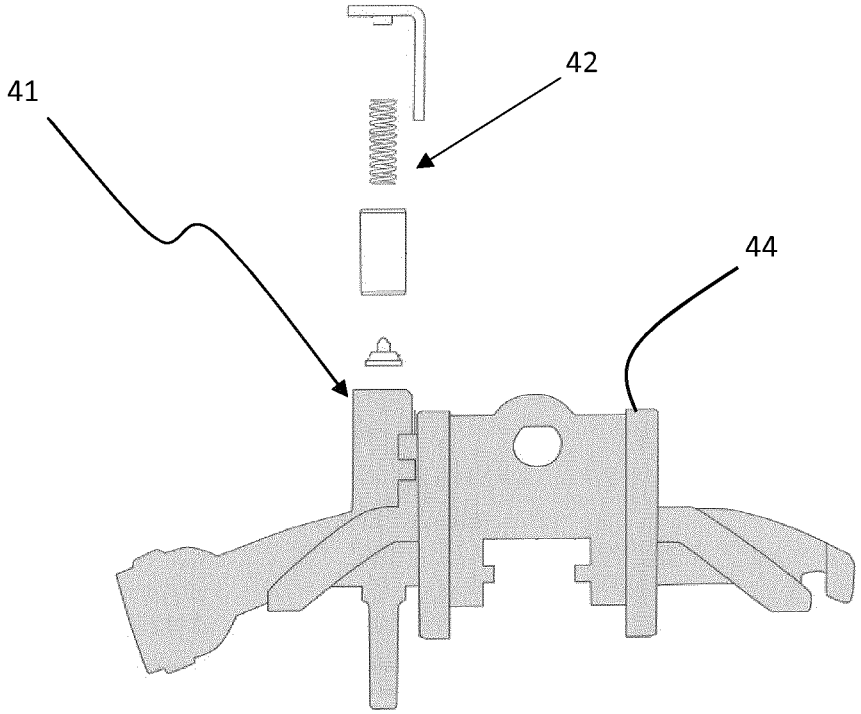
FIG. 10 represents part of a keg connector, showing a safety relieve valve in accordance with the present invention.

An embodiment of dispense connector 38*a* connected at one end to a dispense tube 32 and provided at the other end with a dispense tip 38*b* is illustrated in FIG. 10. A gas connector 39*b* has a similar geometry as the dispense connector 38*a* and a second illustration of the gas connector 39*a* is not required. The dispense and gas connectors 38*a*, 39*a* are coupled to the support element 44 such that the dispense tip 38*b* and gas tip 39*b* are separate from each other and extend along the longitudinal direction, Z. The dispense and gas tips 38*b*, 39*b* must be sufficiently long, hard and sharp to penetrate and, if required, pierce the seals of corresponding dispense and gas openings 22, 25 of the closure 25. In FIGS. 2 to 9, the dispense and gas tips 38*b*, 39*b* are illustrated as extending substantially normal to the dispense and gas tubes 32, 34. Whilst this configuration is advantageous, other geometries are possible, including tips 38*b*, 39*b* extending coaxially with the corresponding dispense and gas tubes 32, 34. For hygiene reasons, it is particularly preferred that the dispense connector 38*a* comprises a dispense tip 38*b* which can be replaced with every new dispense tube 32 and keg, such that the whole flow path of the beverage from the keg to the dispense end 38*c* of the dispense tube 32 be free of bacteria and dirt from previous kegs.

The dispense and gas connectors 38*a*, 39*a*) can be coupled to the keg connector 31 and, in particular, to the support element 44 by any quick, fluid tight, and reversible means. In particular, snap fittings are preferred, but bayonets, screw nuts, or a system of latch or securing pin can also be used. In a preferred embodiment, neither the keg base body 36 nor the dispense and gas connectors 38*a*, 39*a* comprise any sealing element. This is possible provided the closure 2 comprises appropriate sealing elements at the dispense and gas openings 22, 25 thereof as described supra.

It is clear that the coupling of a keg connector 31 to the neck 5 of the keg outer shell 3, will impact on the overpressure relief mechanism (8, 27) between the closure and the keg, resulting in an increased threshold value ($P_{O1'}$) of the overpressure at which the closure shifts from a sealing position to a relief position, if not inhibit shifting of the closure between both positions. Bulging of the closure, allowing disrupting the sealing between the inner bag and the closure however may still occur.

In case the keg connector is designed to fix solely to the closure 2 rather than on the neck of the outer shell 3 of the keg, the overpressure relief mechanism (8, 27) between the closure and the keg may remain unaffected or can be impacted, resulting in an increased threshold value ($P_{O1'}$) of the overpressure at which the closure shifts from a sealing position to a relief position, if not inhibit shifting of the closure between both positions. Bulging of the closure, allowing disrupting the sealing between the inner bag and the closure however may still occur.

The overpressure relief valve 42 in the keg connector 31 can be executed according to several alternative embodiments well known to a person skilled in the art such as a spring biased ball valve or a resilient polymer valve, yet is preferably reversible, meaning that the valve closes again when pressure is relieved to a sufficiently low level, after which the overpressure relief valve maintains its functionality.

In accordance with the present invention, the overpressure relief valve (illustrated in FIG. 10) is preferably designed to be activated (to open) when overpressure $P_{O2}$ (difference in pressure between the fluid tip 39*b* and the atmosphere ($P_{atm}$)) is in a range of 3.5 to 6 bar, preferably in a range of 5.2 to 5.8 bar (measured at 23° C.).

The assembly of keg, closure and keg connector 31 of the described embodiments allows the fast and reliable connection to a keg 1, in particular to a bag-in-container keg, of a dispense tube 32 and a gas tube 34. With a single move of the actuation means, in particular of a lever 40, the keg connector 31 is firmly fixed to the keg neck 5, preferably provided with the collar 8*b*, or to the keg closure 2. This easy to use keg connector is particularly suitable for kegs which are stored under the counter or in pub cellars with no easy access, or for specialty beers being stored in kegs of smaller dimensions which must be changed more often than large, e.g., 50 l kegs.

The invention claimed is:

1. A kit for dispensing a beverage through a dispense tube (32) comprising a dispense valve (33), the kit comprising:

an assembly of a keg (1) and a closure (2), the keg (1) comprising an outer shell (3) having a neck portion (5) defining a first access opening (6) and a flexible inner bag (10) having a neck finish (12) defining a second access opening (13); the closure (2) adapted to be fixed to the keg (1) in a sealing position wherein the closure (2) seals the first (6) and second (13) access openings of the keg (1) thereby defining two sealed spaces, an intermediate space defined between the outer shell (3) and the flexible bag (10) and an inner space inside the flexible bag (10), the closure (2) comprising at least two distinct access ports, a first access port (25) dedicated to the first access opening (6) and a second access port (22) dedicated to the second access opening (13), the keg (1) and closure (2) assembly comprising:

a. an inner vent mechanism incorporated in the closure (2) or at the interface of keg (1) and closure (2), the inner vent mechanism configured to fluidly connect the inner space and intermediate space when an overpressure of predetermined value $P_{o0}$ occurs in the flexible bag (10); and b. a safety relief mechanism (8*a*,8*b*,27) incorporated in the closure (2) or at an interface of closure (2) and keg (1), the safety relief mechanism (8*a*,8*b*,27) designed to relieve pressure when an overpressure of predetermined value $P_{o1}$ occurs in the keg (1), wherein $P_{o1}$ is larger than $P_{o0}$;

a keg connector (31) for fluidly connecting the interior of the keg (1) with the dispense tube (32) connected to the dispense valve (33) and with a pressure gas tube (34) connected to a source (35) of pressurized fluid, said keg connector (31) comprising a base body (35) and further comprising the following elements:

a) coupling means (40) for firmly and releasibly connecting the keg connector (38) to the neck portion (5) of the keg (1) or to the closure (2) of said keg (1) for which the keg connector (31) is designed;

b) a dispense connector (38*a*) comprising a substantially straight dispense tip (38*b*) extending along a longitudinal axis, Z, in fluid communication with a second end connected or connectable to the dispense tube (32) in fluid communication with the dispense valve (33);

c) a gas connector (39*a*), comprising a substantially straight gas tip (39*b*) extending along said longitudinal axis, Z, and physically separate from the dispense tip (38*b*), said gas tip (39*b*) being in fluid communication with a second end connected to the gas tube (34) connected or connectable to the source (35) of pressurized fluid;

wherein said keg connector (31) comprises an overpressure relief vent (41) being in fluid communication with, on the one hand, the gas tip (39*b*) and, on the other hand, the atmosphere and with an overpressure relief valve (42) arranged in said overpressure relief vent (41), the overpressure relief valve (42) designed to relieve pressure when an overpressure in the gas tip (39*b*) reaches a predetermined overpressure value $P_{O2}$ and in that at least one of following conditions are fulfilled:

i the predetermined overpressure $P_{O2}$ at which the relief valve opens is smaller than $P_{o1}$;

ii the coupling of the keg connector (31) to the keg (1) or closure (2) increases the overpressure $P_{O1}$ needed to activate the overpressure relief mechanism in the closure (2) or at the interface of keg (1) and closure (2) to an overpressure $P_{O1'}$ larger than $P_{O1}$, with $P_{O1'}$ being larger than $P_{O2}$.

2. The kit according to claim 1, with $P_{O2}$ selected in a range of 3-5 bar to 6 bar at a temperature of 23° C.

3. The kit according to claim 2, with $P_{O2}$ selected in a range of 5.2 bar to 5.8 bar at a temperature of 23° C.

4. The kit according to claim 1, wherein the second access port (22) of the closure (2) is closed by a wedge portion prior to coupling of the keg connector (31) to the keg (1), the dispense tip (38*b*) of the keg connector (31) piercing the wedge portion upon activation of penetration actuation means and the second access port (22) remaining open upon uncoupling the keg connector (31) from the keg (1).

5. The kit according to claim 1, the closure (2) comprising first and second distinct sealing members (28,29), the first sealing member (28) designed to engage the neck portion (5) of the outer shell (3) and sealing the interior of the outer shell (3) from the atmosphere and the second sealing member (29) engaging the neck finish (12) of the inner bag (10) and sealing the interior of the inner bag (10) from the atmosphere and from an intermediate space between the outer shell (3) and the inner bag (10), the first access port (25) of the closure (2) situated inward from the first sealing member (28) and outward from the second sealing member (29), the second access port (22) situated inward from the second sealing member (29).

6. The kit according to claim 5, wherein the overpressure relief mechanism incorporated at the interface of the closure (2) and the keg (1) comprises a fixation between the closure (2) and the keg (1), the fixation comprising two positions, the closure (2) being movable between a first sealing position wherein the first and second sealing members (28,29) of the closure (2) engage the keg (1) and a second position, wherein at least the sealing between the first sealing member (28) and the neck finish (12) of the outer shell (3) of the keg (1) is disrupted.

7. The kit according to claim 6, wherein the overpressure relief mechanism incorporated at the interface of the closure (2) and the keg (1) comprises a fixation between the closure (2) and the keg, the fixation comprising two positions, the closure being movable between a first sealing position wherein the first and second sealing members of the closure engage the keg (1) and a second position, wherein at least the sealing between the first sealing member (28) and the neck portion (5) of the outer shell (3) and the sealing between the second sealing member (29) and the neck finish (12) of the inner bag (10) are both disrupted.

8. The kit according to claim 6, wherein the first access port (25) of the closure (2), dedicated to the intermediate space between the outer shell and the inner bag (10) of the keg (1) is open to the atmosphere prior to the coupling of the keg connector (31) to the keg (1).

9. The kit according to claim 6, wherein the first access port (25) of the closure (2), dedicated to the intermediate space between the outer shell (3) and the inner bag (10) of the keg (1), is sealed from the atmosphere prior to the coupling of the keg connector to the keg (1).

10. The kit according to claim 5, the closure (2) comprising a base (16) provided with a hub (18) having a peripheral edge extending into a skirt (17) and an inner edge of the hub (18) extending into a central disc (19) by an intermediate wall (20) provided with an outwardly directed first shoulder (21) adjacent to the hub (18), and a further cylindrical wall portion (23) provided on said disc (19), the further wall portion (23) extending in a same sense as the skirt (17) and having a diameter that is smaller than the diameter of the disc (19), thereby creating a second shoulder (24), such that, when the closure (2) is fixed to the keg (1) in said sealing position, the first sealing member (28) is positioned in the first shoulder (21) and engages both said shoulder (21) and the inner edge of the neck portion (5) of the outer shell (3); and the second sealing member (29) is interposed between the second shoulder portion (24) and the inside of the neck finish (12) of the inner bag (10).

11. The kit according to claim 10, wherein the inner vent mechanism is realized in that the base of the closure (2) is flexible, allowing bulging of the base in case a predetermined overpressure $P_{o0}$ occurs in the keg (1), thereby disrupting the sealing between the second sealing member (29) and the neck finish (12) of the inner bag (10).

12. The kit according to claim 1, wherein the neck portion (5) of the outer shell (3) comprises an outwardly extending rim, the coupling means of the keg connector (31) comprising latches cooperating with the rim thereby firmly connecting the keg connector (31) to the neck portion (5) of the keg (1).

* * * * *